United States Patent [19]

Danguy des Deserts et al.

[11] Patent Number: 4,968,180

[45] **Date of Patent: * Nov. 6, 1990**

[54] OSCILLATING MARINE PLATFORM CONNECTED VIA A SHEAR DEVICE TO A RIGID BASE

[75] Inventors: Loic M. J. Danguy des Deserts; Francois G. Sedillot; Dominique Michel, all of Paris, France

[73] Assignee: Doris Engineering, France

[ * ] Notice: The portion of the term of this patent subsequent to Jan. 10, 2006 has been disclaimed.

[21] Appl. No.: 184,879

[22] Filed: Apr. 22, 1988

Related U.S. Application Data

[63] Continuation-in-part of Ser. No. 34,944, Apr. 6, 1987, Pat. No. 4,797,034.

[30] Foreign Application Priority Data

Oct. 24, 1986 [FR] France ..... 86 14784
Apr. 30, 1987 [FR] France ..... 87 06160

[51] Int. Cl.[5] ..... E02B 17/02

[52] U.S. Cl. ..... 405/202; 405/224; 405/227

[58] Field of Search ..... 405/195, 202, 224, 227, 405/204

[56] References Cited

U.S. PATENT DOCUMENTS

| | | | |
|---|---|---|---|
| 3,756,033 | 9/1973 | Kouka . | |
| 4,152,087 | 5/1979 | Zaleski-Zamenhof et al. | 405/195 |
| 4,175,890 | 11/1979 | Taylor | 405/202 |
| 4,505,620 | 3/1985 | Andrier . | |
| 4,610,569 | 9/1986 | Finn et al. | 405/202 |
| 4,621,949 | 11/1986 | Marshall et al. | 405/202 |
| 4,696,603 | 9/1987 | Danaczko et al. | 405/227 |
| 4,696,604 | 9/1987 | Finn et al. | 405/227 |
| 4,705,430 | 11/1987 | Nill | 405/227 |
| 4,717,288 | 1/1988 | Finn et al. | 405/202 |
| 4,797,034 | 1/1989 | Danguy des Deserts | 405/202 |

FOREIGN PATENT DOCUMENTS

| | | |
|---|---|---|
| 2066336 | 7/1981 | United Kingdom . |
| 2162568 | 2/1986 | United Kingdom . |
| 2162883 | 2/1986 | United Kingdom . |
| 2177744 | 1/1987 | United Kingdom . |

*Primary Examiner*—David H. Corbin
*Attorney, Agent, or Firm*—Stevens, Davis, Miller & Mosher

[57] ABSTRACT

A marine platform comprising a deck supported by a tower composed of a rigid fixed structure of the jacket type anchored to the sea floor, an oscillating structure supported by and connected to the fixed structure by flexible piles anchored in the lower part of the fixed structure and arranged on the periphery of the oscillating structure, and by a shear device, the oscillating structure being equipped with a floater. In one embodiment the connection between the fixed and oscillating structures is located in a zone between 30 and 60% of the water depth from the water level. The shear device consisting of at least one set of pairs of structural elements placed obliquely or perpendicularly with respect to the axis of the tower between a lower part of the upper structure and an upper part of the lower structure or of the base and allowing transmission of shear forces and torsional moments between the two parts.

15 Claims, 7 Drawing Sheets

2
12
4
II
II
1
IV
5
3
III
III
VI
V
8
7
6
11

10
92
9
91
10
5

5
11

7
8
6

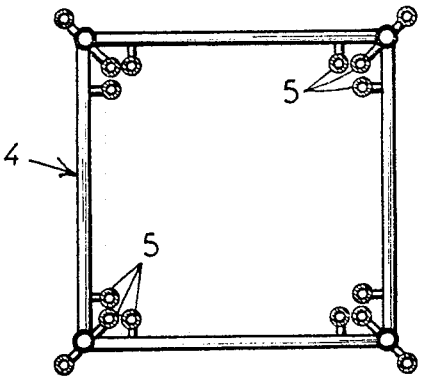
FIG.: 2
FIG.: 3
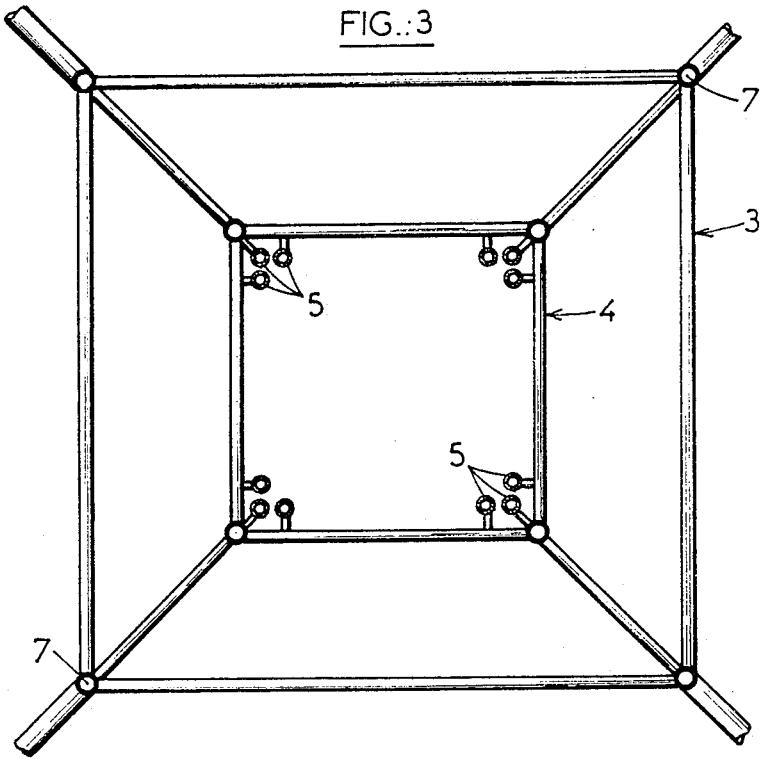

OSCILLATING MARINE PLATFORM CONNECTED VIA A SHEAR DEVICE TO A RIGID BASE

This application is a continuation-in-part of application Ser. No. 034,944, filed Apr. 6, 1987, now U.S. Pat. No. 4,797,034.

The present invention relates to a segmented marine platform, for use in very deep waters, having a fixed base connected to an associated oscillating part by flexible piles and a shear device.

Marine platforms which support, for example, drilling equipment, when used in depths of water greater than 300 meters, require special structural design. Typically these designs are flexible structures, which may be guyed and further may be articulated at one location. When static or dynamic forces, such as wind, current, or waves, become very large, these known structures require large quantities of material to withstand these forces. Accordingly, these known structures, when used in very deep water, are prohibitively expensive.

Further, when the current increases over the entire water depth, the resulting rotational moment generated from the ocean floor on the flexible tower increases. Increased rotational moment may be compensated for by increased righting moment of the articulated structures or increase the rigidity of the flexible towers.

The righting moment of articulated towers can be increased by increasing the size of the floaters used at the upper portion of these towers. However, increasing the size of the floaters increases their surface area. Increased surface area increases the tower's response to currents, thus making additional enlargement of the floaters necessary. In theory this approach for increasing a tower's righting moment is possible, but requires such large quantities of steel that the practicality of this approach is questionable.

For flexible guyed towers, as described in the U.S. Pat. No. 4,417,831, the effect of the current can be counteracted by a very substantial increase in the rigidity of the guys. However, this overall increase in the rigidity of the guys, without an increase in the mass of the tower-guys system, results in a lowering of the natural period of oscillation of the structure. This period then approaches the range of the wave periodicity. To avoid harmful resonance effects in the tower, the inertia of the structure may be increased to lengthen its natural period. Here again, to increase the inertia of the structure, an increase in the dimensions of the guys is required with an associated increased quantities of steel and cost.

Where flexible towers, such as those described in the French Pat. No. 2,552,461, are concerned, the effect of the current may be counteracted by an increase in the rigidity of the tower. Again, this proportionately reduces the natural period of the structure which then comes within the range of the waves periods. To lengthen this natural period, the dimensions of the floater, located on the upper part of these towers may be increased. Here again, dynamic forces such as current on the flexible tower may then increase, thereby requiring the tower to be even more rigid. If this approach leads to a functional solution, which may not happen, again the quantities of material required are such that the technical and economic feasibility of this approach is doubtful.

The present invention avoids the above disadvantages arising from the static and dynamic forces. The following reasoning produced this invention: if there were no dynamic excitation of a tower, e.g., no waves, a fixed structure, for example of the "jacket" type in a metal trellis work, would be used because this structure best withstands static forces.

However, when dynamic considerations are introduced, especially when towers are used in very deep waters, the natural period of this structure results in substantial dynamic amplification. Installing a flexible structure above a fixed structure makes it possible to benefit from the respective advantages of each design, without having their respective disadvantages. The flexible part installed in the upper zone, due to its dynamic response, makes it possible to filter out wave effects, while the fixed part located in the lower zone make it possible to withstand the static forces effectively.

In U.S. Pat. No. 4,610,569, such a structure is disclosed. There the area of connection between the upper and lower parts of such a tower is located at a height of between 10% and 50% of the water depth, as measured from the bottom. A disadvantage of this tower, however, is that the secondary natural periods of the structure is about 7 seconds, which is disadvantageously close to the periodicity of waves.

The object and result of the present invention differs from those of the preceding patent, due in part to a different design which allows the area of connection between the lower and upper structures to be closer to the ocean's surface. This reduces the total movements of the deck, while at the same time preserves a primary natural period of the total structure greater than 20 seconds. This result is achieved by locating the area of connection of the upper and lower parts in a zone located between 40 and 70% of the water depth from the bottom.

A marine platform according to the present invention is a tower composed of a rigid fixed structure anchored to the sea floor and of an oscillating structure supported by the fixed structure and connected on the fixed structure by a system of flexible piles and a crossed-element shear device. The oscillating structure is further equipped with a floater.

Explanations and figures are given below, by way of example, to further describe the invention.

FIGS. 2 and 3 are sectional views along the respective lines II—II and III—III of FIG. 1;

Figures 1, 4, 5, 6:
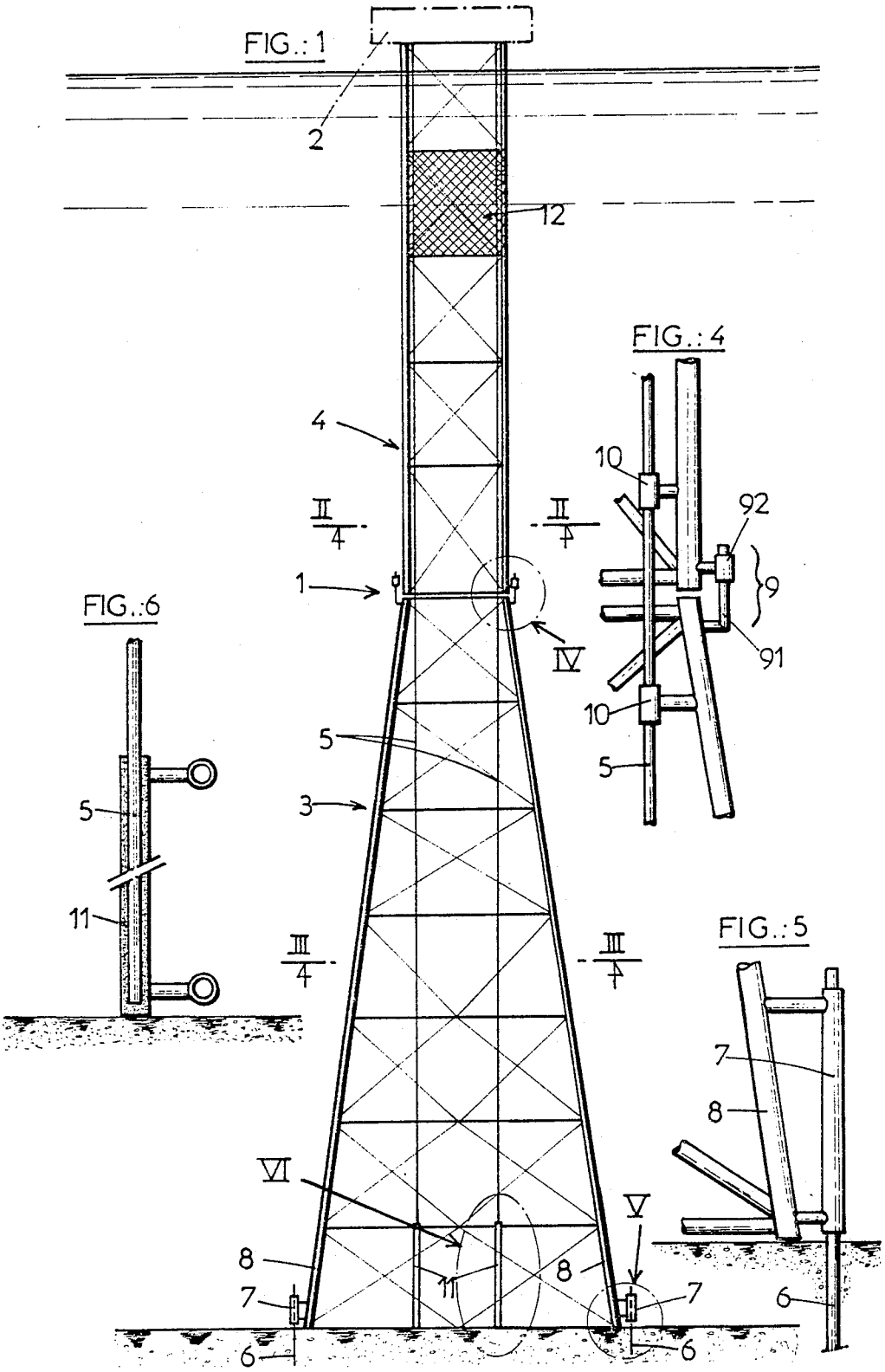
FIG. 1 is an elevation view of a platform according to the invention.
FIG. 4 is an enlarged view of the detail IV of FIG. 1, showing a first embodiment of a shear device.
FIG. 5 is an enlarged view of the detail V of FIG. 1.
FIG. 6 is an enlarged view, in longitudinal section, of the detail VI of FIG. 1.

The marine platform according to the present invention, as illustrated in FIG. 1, is a tower 1 supporting a deck 2, on which, for example, drilling and production equipment is installed.

The tower is composed of two parts, a lower part which is a rigid fixed structure 3, for example of the "jacket" type in a metal trellis work, anchored to the sea floor, and an upper part which is an oscillating structure 4, for example of a metal trellis work. The oscillating structure is supported by and is connected to the fixed structure 3 by means of a system of flexible piles 5 and a crossed-member shear device 9.

The lower fixed structure transmits to the sea floor the reactions of the oscillating structure 4 and the current forces exerted directly on it. This structure is conventional and in this embodiment has a polygonal cross-section, which is square in this particular example. The fixed structure is anchored to the sea floor by means of piles 6 which are buried in the sea floor and which are connected rigidly at their lower parts to guides 7 fixed to the legs 8 of the fixed structure (FIG. 5).

The oscillating structure 4 of this embodiment is also polygonal in cross-section. Flexible piles and a shear device connect the oscillating structure to the fixed structure. The flexible piles are arranged on the periphery of the oscillating structure, are fixed rigidly to the upper part of the structure and, in the embodiment illustrated, are grouped at the corners of the structure. The piles are guided in sleeves 10 along the oscillating structure and then along the fixed structure, to which they are anchored rigidly to its lower part (FIGS. 2, 3 and 6). Accordingly, length variations imparted to the piles as a result of the oscillations of the upper tower are distributed over a substantial length of the piles.

FIG. 6 shows the anchoring of a flexible pile in a sleeve 11 fastened to the lower end of the fixed structure. The pile can be fixed in the sleeve in the known way by grouting or by welding.

According to other embodiments, the flexible piles may be embedded in the sea floor or fastened onto the fixed structure at a level above the sea floor.

Because the flexible piles 5 are arranged on the periphery of the oscillating structure they ensure the stability of the oscillating structure by generating a righting moment. This righting moment is equal to the product of the axial rigidities of the piles and the square of the distance from the geometric center of the plane of rotation. The magnitude of the righting moment from the flexible piles is large enough that the entire oscillating structure's righting force can be imparted by these flexible piles, replacing the need for guys or floaters, as used in the prior art. The flexible piles also ensure that all the vertical forces generated in the structure are transmitted to the lower part.

The shear device 9, located at the lower part of the oscillating structure, makes it possible to transmit the shear forces and torques generated in the flexible structure to the lower fixed structure 3. Further by minimizing the transfer of axial forces and bending moments, the shear device facilitates the unaltered oscillation of the upper part.

In the embodiment shown in FIG. 4, the shear device is composed of a set of shear pins 91 located at the upper end of the lower structure 3 which slide in the guide 92 of the upper structure, while at the same time preventing horizontal displacements.

Figure 7:
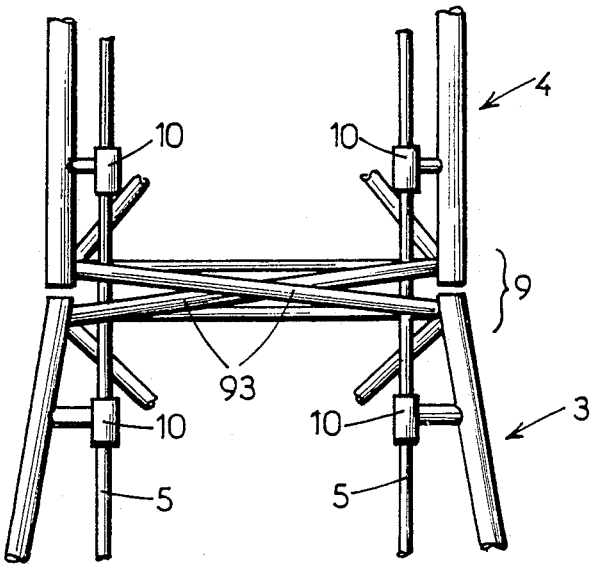
FIG. 7 is an elevation view of the detail IV of FIG. 1 showing a second embodiment of a shear device.

In another embodiment shown in FIG. 7, the shear device is composed of a set of crossed structural elements 93 which link each side or each corner of the lower structure 3 to any of the opposite or adjacent sides or corners of the upper part 4.

FIG. 7 is a partial view of an oscillating tower having a flexible piles type connection and a shear device. In this embodiment, the flexible piles 5 are guided in guides 10 secured to the corners of an upper structure and corners of a lower structure. The force transmitting device consists of crossed bars 93 connecting, respectively, the end of corners of the upper structure to the end of a following or preceding corners of the lower structure. To prevent any interference, the two bars are offset from one another primarily in the vertical plane.

The shear device may be used on platforms comprising a deck supported by a tower secured to the seabed and containing at least one articulation of the cardan joint type or of ball joint type or connection with flexible piles. These articulations or connections must transmit the reactions of the structure, especially the forces at the base, while at the same time allowing the structure to oscillate in any vertical plane passing through the center of rotation.

Although cardan joints transmit all the forces effectively, by contrast ball joints and connections with flexible piles require devices capable of transmitting the horizontal and torsional forces.

Thus, in French Patent No. 2,478,701, the ball joint is completed by an antitorsion device formed by a cardan connection which is concentric to the articulation and of which two opposite angles of the frame are supported by the lower part of the tower and the other two by the base. This device is satisfactory, but it has the disadvantage of being a complex mechanical system which would probably require replacement during the period of platform operation.

French Patent No. 2,568,908 describes another device for the transmission of shear forces and torsional moments, which is used for a flexible piles type connection. The tower receives, on the periphery of its lower end, lateral guides. Shear piles pass through these guides and are fixed to the base or to the foundation. This system prevents the lateral movement and rotation of the tower with respect to its axis and allows the shear forces and torsional moments to be transferred to the seabed.

However, there is a considerable risk of wear between the shear piles and their guides. This risk of wear makes it necessary to provide components which can be replaced during the use of the marine platform or to use special materials making it possible to reduce the wear phenomenon, or to provide extra thicknesses allowing their complete wear.

The shear devices of the present invention overcome the disadvantages described above by providing a system for transmitting the shear forces and torsional moments which does not present any risk of wear and which is based on a simple mechanical design. The shear devices consist of at least one set of structural elements spaced obliquely or perpendicularly with respect to the axis of the tower between a lower part of the upper structure and an upper part of the lower structure or of the base, and having their ends connected respectively to the parts of the structures of the tower or of its base.

Figure 13:
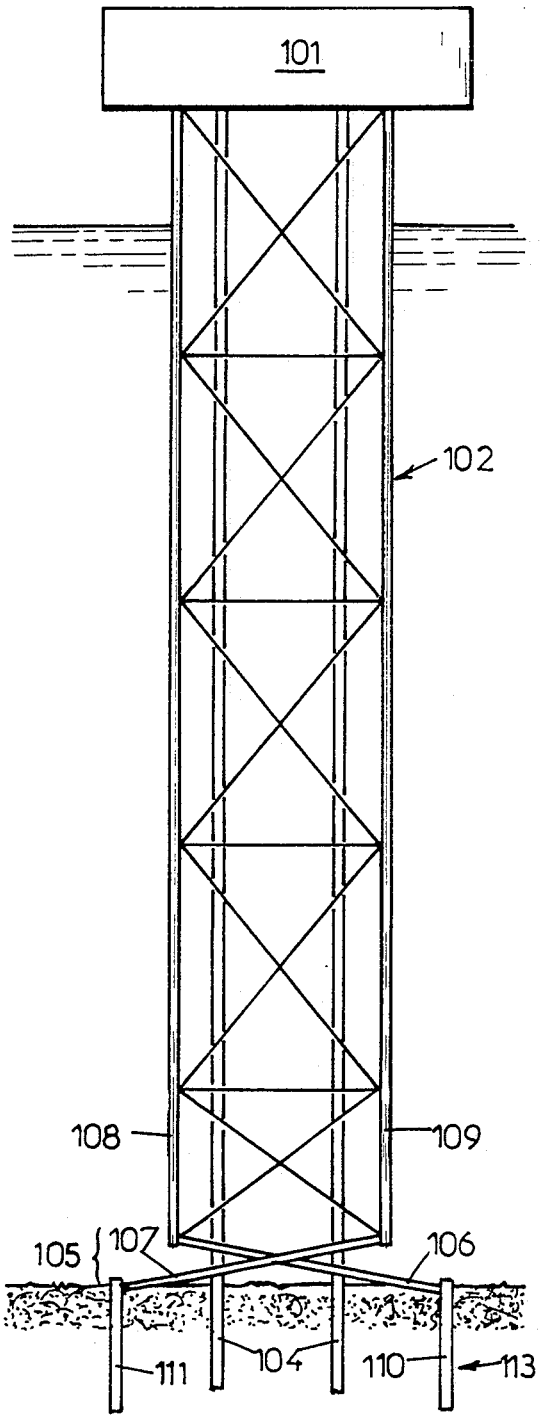
FIG. 13 is an elevational view of an oscillating tower having a shear device connecting the tower directly to the sea floor.

FIG. 13 is an oscillating marine platform. It consists of a deck 101 supported by a tower 102 which, according to the example of embodiment illustrated, consists of a polygonal structure formed by vertical members connected to one another by means of bracings and of a foundation 103.

The tower is fixed to the seabed by means of piles 104 formed, here, by the ends of flexible piles extending over the entire height of the tower and connected to the deck at their upper ends. These piles form a connection of the bottom of the structure to the seabed and, because of their flexibility, allow the platform to oscillate. This type of connection is known from French Patent No. 2,568,908.

In order to absorb the shear forces and torsional moments which the connection must withstand, the device 105 is formed by straight, oblique structural elements 106, 107 fixed at their ends between the lower end of the tower and the foundation.

The foundation consists of piles 110, 111 which, in the example illustrated, are buried into the seabed in a configuration matching that of the polygonal structure of the tower.

The example of FIG. 13 shows two structural elements 106 and 107 positioned obliquely with respect to the axis of the tower and fixed at one of the respective structural member's ends to the lower ends of the corner members 108, 109 of the tower 102, and, at their other ends, to the foundation piles 110, 111. Further because the two elements are crossed, they can absorb shear and torsion forces, in whatever direction; when stressed in any direction one of the structural elements would work under compression and the other under tension, and vice versa. Other identical structural elements 106 and 107 not shown in FIG. 13 are located on the other faces of the polygonal structure at the level of the connection.

The structural elements are, for example, bars, sections or tubes, the physical characteristics of which are selected according to the maximum stresses envisaged for a particular case. In general, these elements are sufficiently resistant longitudinally to transmit the shear forces and the torsional moments between the upper and lower parts of the structure, while at the same time having sufficient slenderness to minimize the transmission of vertical forces and bending moments between the lower and upper parts of the structures or between the structure and its foundation. This combination of traits is necessary to avoid influencing the dynamic behavior of the oscillating marine platform.

In some special operating conditions, if the environmental conditions are suitable, these structural elements are used to transmit all or some of the vertical force of the tower and obtain all or some of the righting moment which ensures the stability of the tower.

In the example illustrated in FIG. 13, the structural elements 106 and 107 are connected rigidly to the structure and to the foundation. In another embodiment (not shown) these structural elements, at their ends, may connect by means of mechanical joints or by any other connection means, allowing the elimination of bending forces in these elements. However, if these elements are too slender or are composed of cables or chains, they may not withstand compressive forces.

To simplify the above description of the shear devices, it has been assumed that the ends of the structural elements are fixed to the corners of the tower and to the preceding or following anchoring points on the foundation. However, fixing the elements to any point on the lower end of the structure and on the foundation, or on another part of the structure is possible, provided that the elements are placed obliquely or perpendicularly with respect to the axis of the tower.

Figure 14:
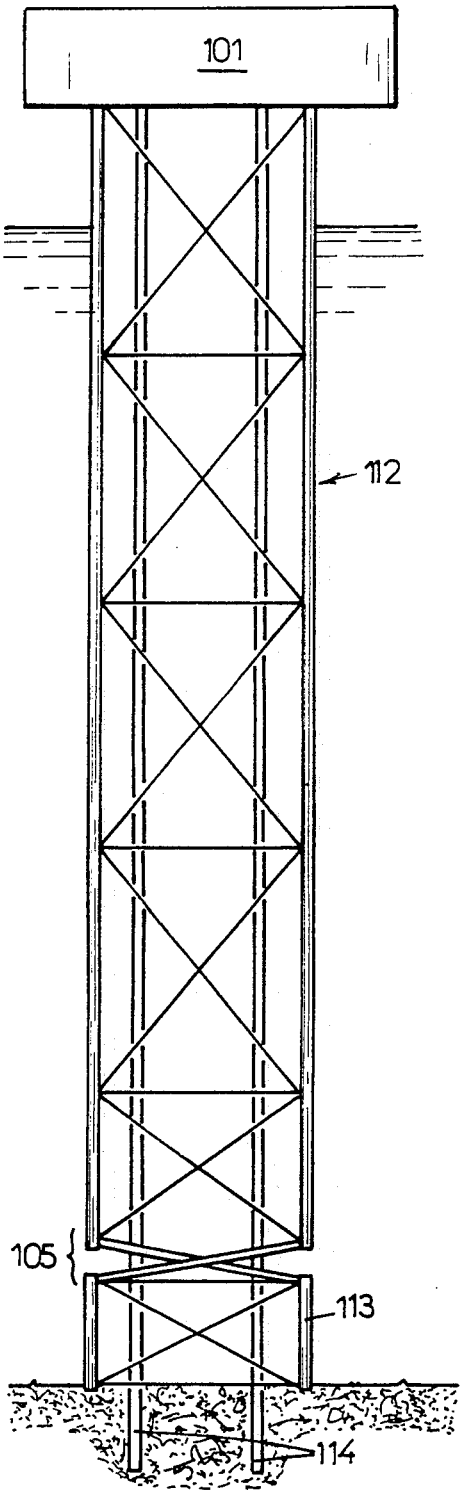
FIG. 14 is an elevational view of an oscillating tower having a shear device connecting the oscillating structure to a fixed structure.

FIG. 14, shows a second embodiment of a device 105, the device connecting a tower 112 to a fixed base 113. The base 113 consists of a lattice structure fixed to the sea floor. As in the preceding example flexible piles 114 link the tower to its fixed base.

Figure 15:
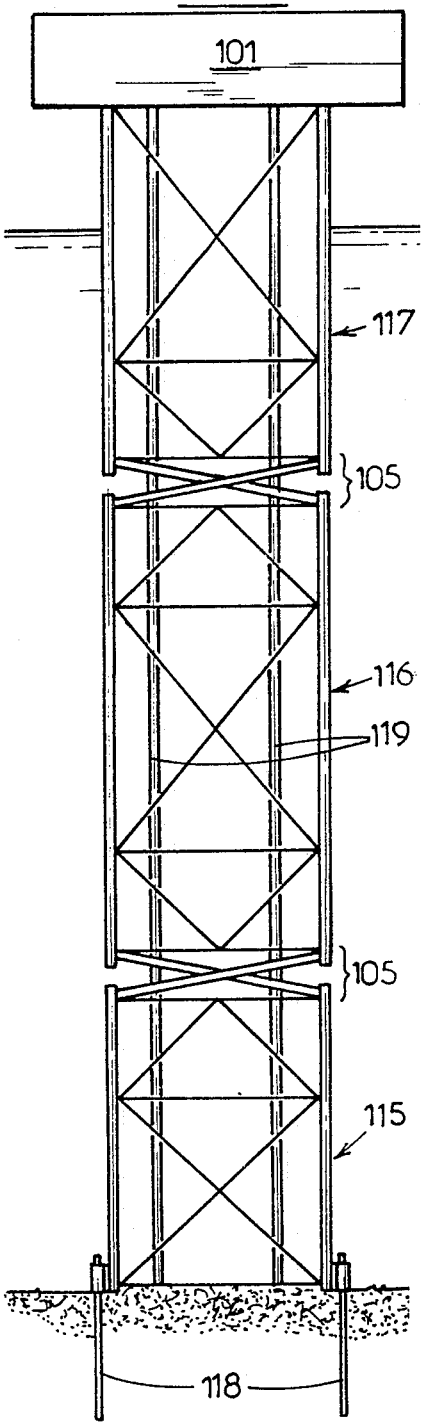
FIG. 15 is an elevational view of a platform having a fixed structure and further the tower has a second oscillating structure and a second cross-member shear device.

FIG. 15 shows a third embodiment of a device 105 according to the present invention. The tower illustrated consists of three parts: a fixed base structure 115 anchored to the sea floor by means of anchoring piles 118, an intermediate structure 116 connected to the fixed base structure 115 by means of flexible piles 119 and by a device 105 and an upper structure 117 connected to the intermediate structure 116 by means of flexible piles and another device 105. In this example, the flexible piles are the continuation of the flexible piles connecting the intermediate structure to the fixed base structure.

Figure 16:
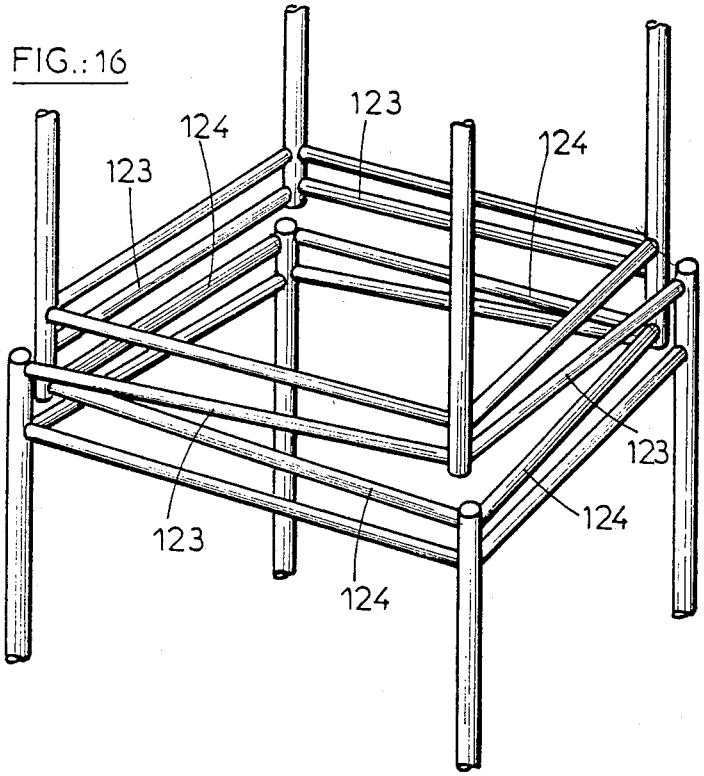
FIG. 16 is a perspective view of another embodiment of the crossed-member shear device.
Figure 17:
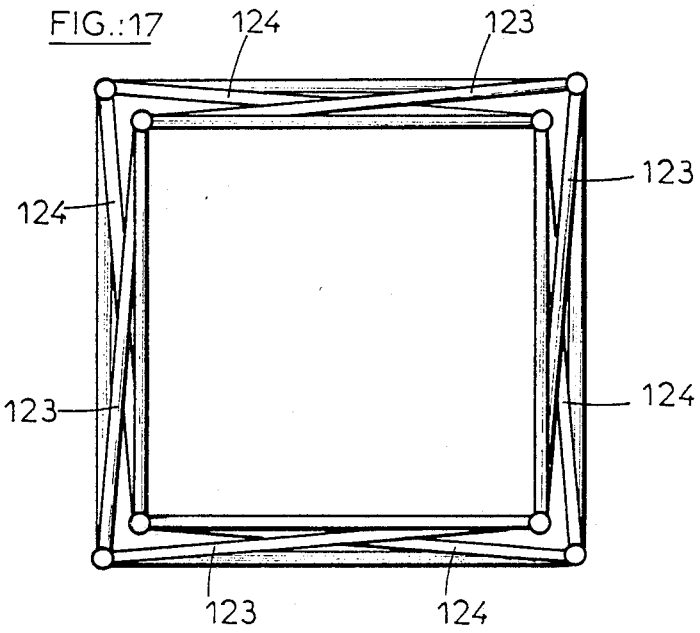
FIG. 17 is a plan view of the embodiment of FIG. 16.

FIGS. 16 and 17 are partial views of another embodiment of a shear device for an oscillating tower. The bars 23 and 24, perpendicular to the axis of the tower, are offset from one another in the horizontal plane. To simplify the drawing, the flexible piles and two lattice structures are not shown.

Figure 18:
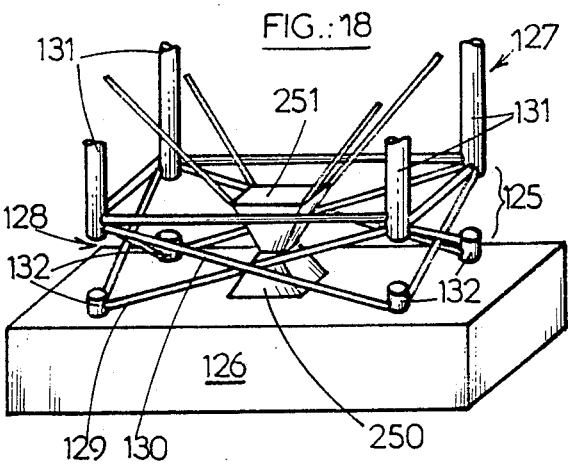
FIG. 18 is a perspective view of a platform articulated on a base on the sea floor, with a crossed member shear device connecting the lower end of the tower to the base.

While the preceding examples show connections consisting of flexible piles, the shear device of the present invention can be used with all types of connections and articulations and, in particular, with ball joints. FIG. 18 is a depiction of such a combination.

Part 250 of the ball joint 125 is secured to a base 26 resting on the sea floor and is retained either due to its own weight or by anchoring piles (not shown). The lower part of the tower 127, which, in the example illustrated, is a lattice structure of rectangular cross-section, uses braces to connect to the other part of 251 of the articulation so as to ensure the fixation of part 251. The force transmitting device 128 according to the invention consists of bars 129 and 130 on each side of the structure. As described above, the ends of the bars are fixed between the lower ends of the corner members 131 of the structure and securing blocks 132 positioned on the base 126, which are in a configuration matching that of the corner members 131 of the tower structure 127.

The use of the device according to the invention is not limited to polygonal cross-section towers, but can also be used with towers having a cylindrical shaft. In this case, the structural elements are preferably secured between the circumference of the lower end of the oscillating structure and the upper end of the lower structure or of the base, as chords within the circular cross-sections of the cylindrical shafts respectively. In the cylindrical tower case, at least three sets of crossed members must be used to joint the top and bottom towers.

As in the other examples, the adjacent structural elements of the device placed obliquely or perpendicularly with respect to the axis of the tower can be crossed or can go along opposite directions, so that preferably one element is under tension while the other is under compression.

In the embodiments described above, the structural elements are placed so as to not cross the contour projected in the horizontal plane at the level of connection or articulation. This hypothesis has been assumed implicity in order to simplify the figures and the explanations, but in general terms there is no constraint to do so other than those resulting from the congestion of the inner volume of the tower due to the passage of the conductor pipes and the flexible piles or the ball joint system.

Figure 12:
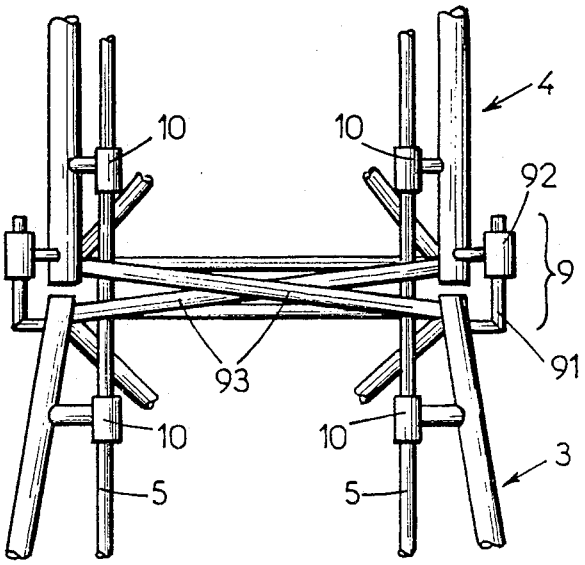
FIG. 12 is an enlarged view of the detail IV of FIG. 1, showing a combination of the first embodiment and the second embodiment of a shear device.
Figure 8:
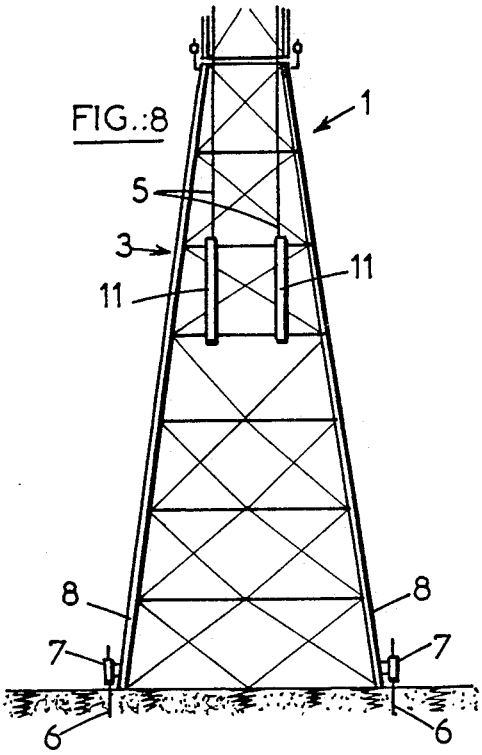
FIG. 8 is an elevational view of the rigid fixed structure wherein the flexible piles are fastened to said fixed structure at an upper level.
Figure 9:
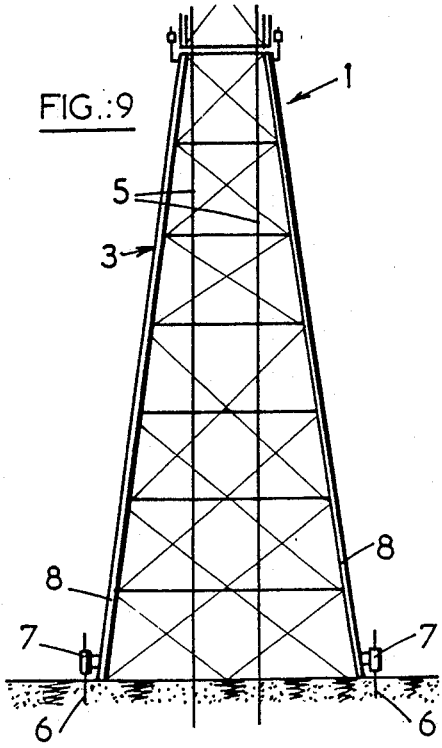
FIG. 9 is an elevation view of the rigid fixed structure wherein the flexible piles are embedded in the sea floor.
Figure 10:
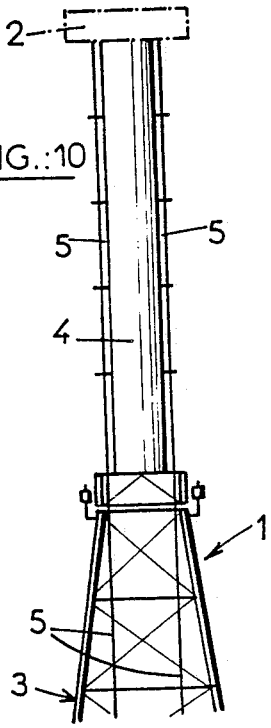
FIG. 10 is an elevation view of the oscillating structure composed of a metal shaft.
Figure 11:
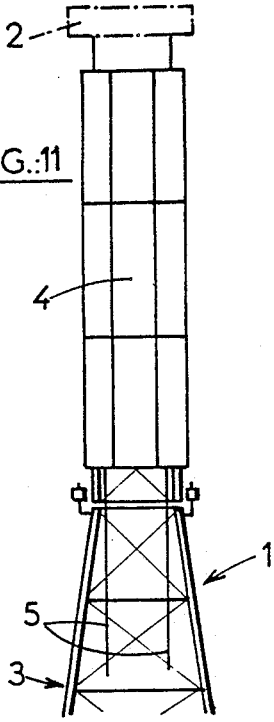
FIG. 11 is an elevation view of the oscillating structure composed of a multi-cellular structure made of concrete.

As shown in FIG. 7, the structural elements 93 limit the freedom of motion between the oscillating structure and the lower fixed structure, the motion being relative horizontal displacements and a relative rotation about vertical axis of the structures. Thus the overall shear force or torque generated in the oscillating structure and transmitted to the lower fixed structure result principally in axial force in the structural elements 93. In another embodiment shown in FIG. 12, the shear device is composed of a combination of the shear pins 91 and the guides 92 with the structural elements 93.

The rigidity of the flexible piles 5 is such that the total solid angle defined by the motion of the oscillating structure generates acceptable axial stresses in these piles. It may be necessary to reduce the axial stress in the piles by means of a floater 12. This element will have a shape which allows, on the one hand, the reduction of the apparent weight of the oscillating structure and, on the other hand, an increase of the natural period of oscillation. In some cases, where the buoyancy function of the floater is unnecessary, this element would only retain the function of increasing the natural period of oscillation.

The floater is located below the mean water level, and its upper end is in a zone between approximately 1/30 and 1/10 of the water depth and, in the example shown, approximately 25 m below the surface.

In this same example, the height of the fixed structure is greater than half the water depth and consequently greater than that of the oscillating structure, the range for the connection between the lower and upper structures being in a zone located between 30% and 60% of the water depth from the water level.

A platform according to the invention, intended for use in a water depth of 600 meters in this example, capable of withstanding currents of 2 m/s at the surface and 1 m/s at the sea floor, shows a gain in weight of the order of 37,000 tons of structural steel in comparison to a conventional oscillating platform. This gain represents 40 to 50% of the quantity of steel used.

According to embodiments shown, the fixed structure and/or the oscillating structure are composed of a metal shaft or of a multi-cellular structure made of concrete.

We claim:

1. A device for the transmission of shear forces and torsional moments in an oscillating marine platform, said marine platform comprising:

at least one oscillating structure having an axis, a lower part, and a plurality of substantially vertical legs;

a support structure having an upper part, which is positioned vertically below the oscillating structure, which supports the oscillating structure;

said device for the transmission of shear forces and torsional moments comprising a connection means for connecting the oscillating structure to the support structure, said connection means having a plurality of flexible piles each having two ends, and at least one set of a plurality of pairs of cross structural members, the flexible piles being arranged on the periphery of the oscillating structure, one set of ends of the respective piles being fastened to the oscillating structure and the opposing ends of the piles being fastened to the sea floor, one of the at least one set of the pairs of cross structural members corresponding to one oscillating structure, the cross structural members each having opposing ends interconnecting legs of the oscillating structure to the support structure, each one of the cross structural members further being connected at one of its ends to the bottom part of the oscillating structure and the opposite end of each cross structural member being connected to the upper part of the support structure.

2. The device of claim 1, where both of the members of all the pairs of the crossed structural members are perpendicular to the axis of the oscillating tower.

3. The device of claim 1, where both of the members of all the pairs of structural members are oblique to the axis of the oscillating tower.

4. The device of claim 1, where the support structure is a fully submerged, fixed structure, anchored to the sea floor and having a plurality of substantially vertical legs.

5. The device of claim 1, where the support structure is a plurality of foundation piles buried in the sea floor.

6. The device of claim 1, where the support structure is a rigid base anchored to the sea floor.

7. The device of claim 1, where the support structure is a second oscillating structure, positioned vertically below the first oscillating structure.

8. The device of claim 1, where structural members have rigid end connections.

9. The device of claim 1, where the structural members at their ends have the connection by means to eliminate bending forces in these members.

10. The device of claim 9, where the means to eliminate bending forces in the crossed structural members further comprises mechanical joints.

11. The device of claim 1, where the structural members are such that they do not withstand compressive forces.

12. A marine platform as in claim 1, where the structural members are such that they do not withstand compressive forces.

13. A device for the transmission of shear forces and torsional moments in an oscillating marine platform, said marine platform comprising:

at least one oscillating structure having an axis, a lower part, and a plurality of substantially vertical legs;

a support structure having an upper part, which is positioned vertically below the oscillating structure, which supports the oscillating structure;

said device for the transmission of shear forces and torsional moments comprising a connection means for connecting the oscillating structure to the support structure, said connection means having an articulation joint and at least one set of a plurality of pairs of cross structural members, the articulation joint directly connecting the bottom of the oscillating structure to the top of the support structure, one of the at least one set of the pairs of cross structural members corresponding to one oscillating structure, the cross structural members each having opposing ends interconnecting legs of the oscillating structure to the support structure, each one of the cross structural members further being connected at one of its ends to the bottom part of the oscillating structure and the opposite end of each cross structural member being connected to the upper part of the support structure.

14. The device of claim 13, where the structural members have rigid end connections.

15. A marine platform as in Claim 13, where the structural members at their ends have the connection by means to eliminate bending forces in these members.

* * * * *